US006961984B2

(12) United States Patent
Naito et al.

(10) Patent No.: US 6,961,984 B2
(45) Date of Patent: Nov. 8, 2005

(54) METHOD AND APPARATUS FOR DETECTING SETTING DEFECTS IN SELF-PIERCING RIVET SETTING MACHINE

(75) Inventors: Nobuharu Naito, Toyohashi (JP); Toshiaki Amano, Toyohashi (JP)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/732,686

(22) Filed: Dec. 10, 2003

(65) Prior Publication Data

US 2004/0148761 A1 Aug. 5, 2004

Related U.S. Application Data

(63) Continuation of application No. PCT/US02/19298, filed on Jun. 18, 2002.

(30) Foreign Application Priority Data

Jun. 20, 2001 (JP) ..... 2001-185762

(51) Int. Cl.[7] ..... B23Q 17/22
(52) U.S. Cl. ..... 29/407.08; 29/716
(58) Field of Search ..... 29/407.02, 407.08, 29/407.1, 432.1, 432.2, 524.1, 525.06, 716, 798

(56) References Cited

U.S. PATENT DOCUMENTS 5,533,250 A 7/1996 Ladouceur
6,067,696 A * 5/2000 Cecil et al. ..... 29/407.08
6,276,050 B1 * 8/2001 Mauer et al. ..... 29/716
6,502,008 B2 * 12/2002 Maurer et al. ..... 29/716
6,543,115 B1 * 4/2003 Mauer et al. ..... 29/407.08

FOREIGN PATENT DOCUMENTS

EP 0 738 550 A2 10/1996
EP 0 893 179 A2 1/1999

* cited by examiner

*Primary Examiner*—David P. Bryant
(74) *Attorney, Agent, or Firm*—Harness, Dickey & Pierce, P.L.C.

(57) ABSTRACT

In order to detect setting defects of a self-piercing rivet in a self-piercing rivet setting machine, on a graph having X-Y coordinates representing a rivet driven stroke and a rivet driving load, a normal upper limit curve 37 defining the upper limit of a normal setting range and a normal lower limit curve 38 defining the lower limit of the normal setting range are plotted to detect a conventionally detectable setting defects. Further, a defect upper limit curve 39 and a defect lower limit curve 41 which are obtained from an additional setting defect different from the conventionally detectable setting defects are plotted between the normal upper limit curve and the normal lower limit curve, so that the additional setting defect is detected when a plotted curve 45 of actual-measurement data of a rivet under a rivet driving operation lies between the defect upper and lower limit curves.

18 Claims, 7 Drawing Sheets

PRIOR ART

PRIOR ART

METHOD AND APPARATUS FOR DETECTING SETTING DEFECTS IN SELF-PIERCING RIVET SETTING MACHINE

CROSS-REFERENCE TO RELATED APPLICATIONS

This application is a Continuation of International Application No. PCT/US02/19298, filed Jun. 18, 2002 and designating the United States. This application claims the benefit of Japanese Application No. 2001-185762, filed Jun. 20, 2001. The disclosure(s) of the above application(s) is (are) incorporated herein by reference.

FIELD OF THE INVENTION

The present invention relates to a detection of setting defects in a self-piercing rivet setting machine. In particular, the present invention relates to a method and apparatus for detecting setting defects of a self-piercing rivet in a self-piercing rivet setting machine for connecting two or more sheet members (or a sheet member and a component) by using the self-piercing rivet in a sheet-metal assembly operation such as automobile assembling (particularly, an aluminum body assembly operation).

BACKGROUND OF THE INVENTION

One example of a self-piercing rivet setting machine is described in Japanese Patent Laid-Open No. 08-505087. FIG. 1 of the publication shows one example of a self-piercing rivet. The self-piercing rivet comprises a flange-shaped head and a leg extending downward from the head. When the self-piercing rivet is driven into workpieces, such as two body panels, by using a punch and a die, the edge of the leg is outwardly expanded and deformed while piercing (boring) the panels by the leg. In this manner, the panels are connected with each other between the outwardly expanded and deformed legs and the head. The self-piercing rivet is suitable for assembling an aluminum body to which welding is not applicable. As aluminum bodies are increasingly employed in automobile bodies to drive forward weight reduction, the demand for the self-piercing rivet would increase in the future. For example, for two body panels as the workpieces, the self-piercing rivet is arranged to allow the leg to penetrate one panel on the side of the flange, but not to allow the edge of the leg to penetrate the other panel on the edge side of the leg. Thus, in addition to the prevention of insufficient driving force, it is required to prevent excessive driving force causing the penetration of the leg edge through the other panel.

A currently used self-piercing rivet setting machine is provided with an apparatus for detecting a rivet driven stroke and a rivet driving load of a self-piercing rivet to determine setting defects corresponding to either insufficient or excessive driving force. The setting-defect detecting apparatus comprises a monitor as display means for displaying and plotting a normal upper limit curve defining the upper limit of a normal setting range and a normal lower limit curve defining the lower limit of the normal setting range on a graph having X-Y coordinates representing the rivet driven stroke and the rivet driving load, means for measuring the rivet driven stroke and rivet driving load of a self-piercing rivet during a rivet driving operation to plot them on the graph, more specifically to perform processing of input data from a pressure sensor, scale or the like to plot them on the graph, and detecting means for detecting whether the plotted value would go across either one of the normal upper and lower limit curves and deviate from the values between both the curves to detect the setting defects of the self-piercing rivet. For example, if the plotted value decreases lower than the normal lower limit curve, it will be determined as insufficient driving force. If the plotted value increases higher than the normal upper limit curve, it will be determined as excessive driving force.

FIG. 1 shows a graph on the monitor. The monitor displays and plots the graph having X-axis representing the rivet driven stroke of a self-piercing rivet (mm) and Y-axis representing a rivet driving load of the self-piercing rivet for the rivet driven stroke (kN (kilo Newton)). On this graph, reference curves A and B are plotted. The upper curve A is a characteristic curve, defining the upper limit of a normal setting range, i.e. a normal upper limit curve, and the lower curve B is a characteristic curve defining the lower limit of the normal setting range, i.e. a normal lower limit curve. If input data of the rivet driven stroke-to-the rivet driving load of a self-piercing rivet under a rivet driving operation are plotted between the normal upper limit curve A and the normal lower limit curve B, its rivet driving operation is determined as normal. If the plotted value goes across either the normal upper limit curve A or the normal lower limit curve B and deviates from the values between both the curves, it will be detected that the self-piercing rivet has been set in a defect state, and thus determined as a setting defect. The normal upper and lower limit curves A, B serving as reference curves are acquired on an experimental basis through self-piercing rivet driving tests. For acquiring the characteristic curves, their values can be determined on an experimental basis, and any suitable values representing a normal setting state may be used. The detected setting defect is indicated to an operator as an alert, and the setting machine stops its operation.

As above, in the conventional setting-defect detecting method, when the plotted value of the self-piercing rivet under the rivet driving operation goes across either the normal upper limit curve A or the normal lower limit curve B and deviates from the values between these curves, it is detected that a setting defect occurs. Then, this setting defect is indicated to an operator, and the setting machine stops its operation. However, it has been found that not all of actual setting defects could be detected by such a setting-defect detection. FIG. 1 shows a curve C of plotted values of a self-piercing rivet under a rivet driving operation. This curve increases substantially linearly between the normal upper limit curve A and the normal lower limit curve B. Under the conventional detecting method, this plotted value is determined as a normal setting state, but not as a setting defect. However, in this case, the self-piercing rivet was actually overturned in the punch of the self-piercing riveting machine, and the rivet driving operation could not be normally carried out. As seen from this fact, according to the conventional setting-defect detecting method, the setting defect caused by either excessive or insufficient driving force can be detected however, any other setting defect different from such setting defects cannot be detected. If the width between the normal upper limit curve A and the normal lower limit curve B is reduced to detect this different type setting defect, many acceptable self-piercing rivets will be detected as the setting defects, and this can be obstacle in the normal setting operation. This proves that setting defects of a self-piercing rivet cannot be sufficiently detected by the conventional setting-defect detecting method.

It is therefore an object of the present invention to provide a method and apparatus for detecting a setting defect of a self-piercing rivet, capable of detecting not only conventionally detectable setting defects of a self-piercing rivet, but also an additional setting defect different from the conventionally detectable setting defects.

SUMMARY OF THE INVENTION

In order to achieve the above object, according to the present invention, in a self-piercing rivet setting machine wherein a self-piercing rivet comprising a flange-shaped head and an annular leg extending downward from the head is driven into a plurality of workpieces by a punch and a die to outwardly expand and deform the edge of the leg while piercing the workpieces with the leg, so as to connect the workpieces with each other between the deformed leg and the head, there is provided a method for detecting a setting defect of the self-piercing rivet comprising the steps of: plotting a normal upper limit curve defining the upper limit of a normal setting range and a normal lower limit curve defining the lower limit of the normal setting range on a graph having X-Y coordinates representing a rivet driven stroke and a rivet driving load; during driving of the rivet, measuring the rivet driven strokes and rivet driving loads of the self-piercing rivet to plot them on the graph; and determining whether the plotted values would deviate from the values between the normal upper limit curve and the normal lower limit curve to detect a first setting defect of the self-piercing rivet. The method of the present invention further comprises the steps of: plotting a defect upper limit curve and a defect lower limit curve between the normal upper and lower limit curves on the graph, the defect upper and lower limit curves being obtained from a second setting defect different from the first setting defect; and determining whether the plotted value of the driven self-piercing rivet lies between the defect upper limit curve and the defect lower limit curve to detect the second setting defect of the self-piercing rivet.

Further, another method for detecting a setting defect of the self-piercing rivet according the present invention comprises the steps of: storing a single defect curve pattern as a reference template, the defect curve pattern being obtained from a second setting defect different from the first setting defect; storing plural actual-measurement data over the entire single rivet driving operation as the actual-measurement data for a single frame, the actual-measurement data being obtained from the plotted value during driving of the self-piercing rivet; calculating respective differences between the reference template data and the single frame actual-measurement data; and integrating values based on the differences to determine the second setting defect on the basis of the magnitude of the integrated value.

Further, still another method for detecting a setting defect of the self-piercing rivet according the present invention comprises the steps of: storing a single defect curve pattern as a reference template, the defect curve pattern being obtained from a second setting defect different from the first setting defect, and the reference template being composed of data varying in each of predetermined rivet driven strokes; recording actual-measurement data of the rivet driving load for the rivet driven stroke, as data varying in each of the predetermined rivet driven strokes, the actual-measurement data being obtained from the self-piercing rivet during driving of the rivet; and comparing the recorded data with the reference template data to detect the second setting defect on the basis of the degree that the recorded data approximates to the reference template data.

The above methods of the present invention make it possible to detect the second (or conventionally undetectable) setting defect only by incorporating either the defect upper and lower limit curves which are prepared and defined from the second setting defect which is different from the first setting defect caused by insufficient or excessive driving force, or the template including the reference curve obtained from the second setting defect, into the conventional method and system according to the normal upper limit curve and the normal lower limit curve.

In the above methods, the second setting defect may be a setting defect caused either by overturning of the self-piercing rivet in the punch, or by insufficient hardness of the self-piercing rivet.

Further, according to the present invention, there is provided an apparatus for detecting a setting defect of a self-piercing rivet comprising a flange-shaped head and an annular leg extending downward from the head for use in a self-piercing rivet setting machine wherein the self-piercing rivet is driven into a plurality of workpieces by a punch and a die to outwardly expand and deform the edge of the leg while piercing the workpieces with the leg, so as to connect the workpieces with each other between the deformed leg and the head, with the setting defect detecting apparatus being operable to display a normal upper limit curve defining the upper limit of a normal setting range and a normal lower limit curve defining the lower limit of the normal setting range on a graph having X-Y coordinates representing a rivet driven stroke and a rivet driving load; to measure the rivet driven strokes and rivet driving loads of the driving self-piercing rivet to plot them on the graph; and to determine whether the plotted values would deviate from the values between the normal upper limit curve and the normal lower limit curve to detect a first setting defect of the self-piercing rivet. The setting defect detecting apparatus of the present invention is further operable: to display a defect upper limit curve and a defect lower limit curve which are obtained from a second setting defect different from the first setting defect, between the normal upper and lower limit curves on the graph; and to determine whether the plotted value of the driven self-piercing rivet lies between the defect upper limit curve and the defect lower limit curve to detect the second setting defect of the self-piercing rivet.

Further, another second setting defecting apparatus of the present invention is operable: to store a single defect curve pattern obtained from a second setting defect different from the first setting defect, as a reference template; to store plural actual-measurement data obtained over the entire single rivet driving operation from the plotted value, as the actual-measurement data for a single frame: and to calculate respective differences between the reference template data and the single frame actual-measurement data and then integrate values resulted from the differences to determine the second setting defect on the basis of the magnitude of the integrated value.

Still another second setting defecting apparatus of the present invention is operable: to store a single defect curve pattern as a reference template, the defect curve pattern being obtained from a second setting defect different from the first setting defect, and the reference template being composed of data varying in each of predetermined rivet driven strokes; to record actual-measurement data of the rivet driving load for the rivet driven stroke, as data varying in each of the predetermined rivet driven strokes, the actual-measurement data being obtained from the driving self-piercing rivet; and to compare the recorded data with the reference template data to detect the second setting defect on the basis of the degree that the recorded data approximates to the reference template data.

DETAILED DESCRIPTION OF THE PREFERRED EMBODIMENT

Figure 1:
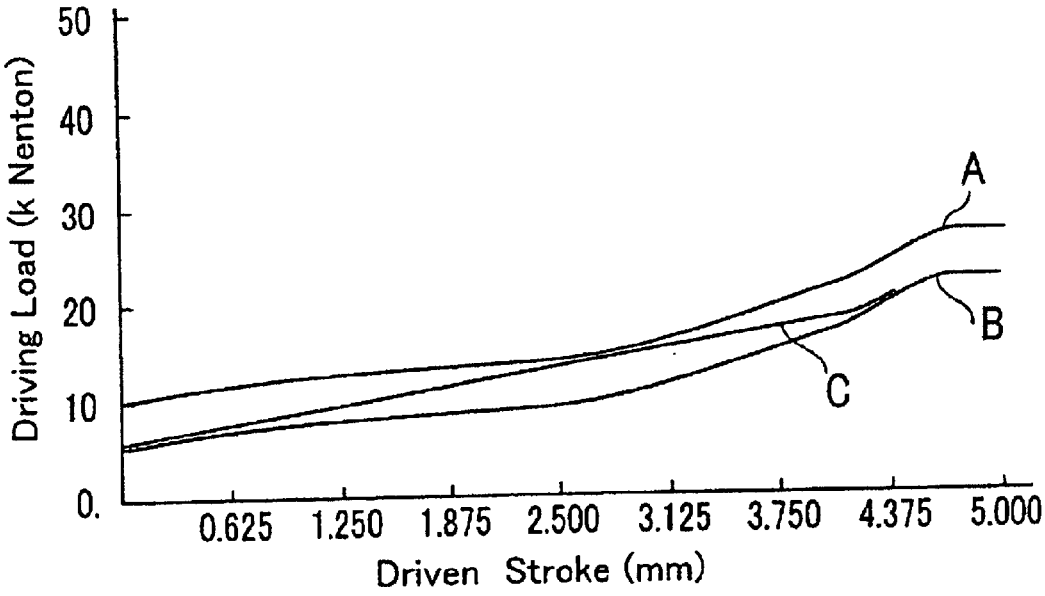
FIG. 1 is a graph of a rivet driven stroke-to-a rivet driving load of a self-piercing rivet, in which normal upper and lower limit curves for detecting a conventional (or first) setting defect and a curve representing another (or second) setting defect are plotted.

Before describing embodiments of the present invention, a conventional self-piercing rivet setting machine 1 will be described with reference to FIG. 2. The self-piercing rivet setting machine 1 comprises a setting section 2 for setting a self-piercing rivet, a control unit 3 for controlling an operation of the setting section 2, a robot 6 serving as means for moving the setting section 2 to a predetermined location of a plurality of panels 5 and 5A as workpieces to be connected to each other, and a rivet feeder 7 for automatically feeding self-piercing rivets to the setting section 2. The control unit 3 also controls the feeding of the self-piercing rivets in the rivet feeder 7. The control unit 3 includes a monitor 9 for displaying and plotting, for example, a graph having X-Y coordinates representing a rivet driven stroke and a rivet driving load. A feeding tube 10 extends from the rivet feeder 7 to a receiver mechanism 11 of the setting section 2 to feed the self-piercing rivets one by one to the setting section 2 continuously. Compressed air is supplied from a pipe 13 to the rivet feeder 7, which uses the compressed air for feeding the rivets.

The setting section 2 includes a C-shaped frame 15 mounted on the edge of an arm 14 of the articulated robot 6, a die 17 mounted on one end (the lower end in the illustrated example) of the frame 15, a punch 18 mounted on the other end (the upper end) of the C-shaped frame 15 and located at the lower portion of the receiver mechanism 11 to face with the die 17 and to be movable to get close and away from the die 17, and a driving motor 19 for moving the punch 18 to get close and away from the die 17. The motor 19 has a shaft formed with a lead screw to provide, to the punch 18*a*, a force for strongly pushing a self-piercing rivet held on the punch 18 against the die 17, in response to the rotation of the motor. The punch 18 can be returned (upward in the illustrated example) by reversely rotating the motor 19. The self-piercing rivet fed from the receiver mechanism 17 is held on the end of the punch 18. The C-shaped frame 15 is advantageously constructed to sandwich the setting point of the panels 5 and 5A to be connected with each other, from above and underneath, respectively, by the punch 18 and the die 17.

Figure 3:
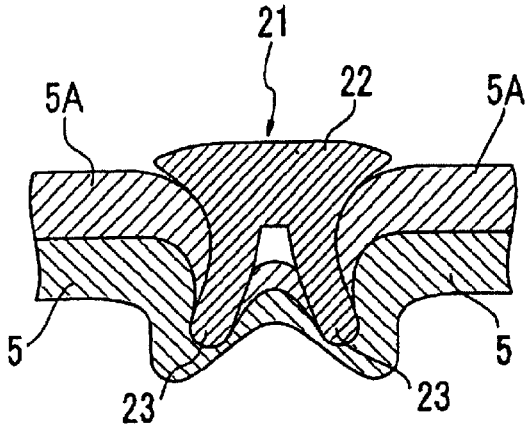
FIG.3 PRIOR ART
FIG. 3 is a sectional view showing that a plurality of panels are connected with each other by a self-piercing rivet.

FIG. 3 shows the state that the panels 5 and 5A are connected with each other with a self-piercing rivet 21 after a rivet driving operation according to the setting machine 1. The self-piercing rivet 21 comprises a flange-shaped head 22 and an annular leg extending downward from the head 22. The self-piercing rivet 21 is driven into a plurality of panels (workpieces) 5 and 5A (although the illustrated example describes two workpieces, the number of workpieces may be three or more) by the punch 18 and the die 17 to outwardly expand and deform the edge of said leg 23 while piercing the panels 5A and 5 with the leg 23, so as to connect the panels 5A and 5 with each other between the outwardly expanded and deformed leg 23 and the head 22. The self-piercing rivet 21 is suitable for connecting aluminum panels to which welding is not applicable, and for assembling an aluminum body which is increasingly employed in automobiles to accelerate weight reduction. As shown in FIG. 3, the self-piercing rivet 21 is set to allow the leg 23 to penetrate the panel 5A on the flange side of the rivet, but not to allow the edge of the leg to penetrate the panel 5 on the edge side of the leg 23. In this manner, no hole is created in the surface of the panel 5 and thereby air-tightness and water-tightness can be maintained in high level. Thus, in addition to the prevention of insufficient driving force, the self-piercing rivet 21 is required to prevent excessive driving force causing the penetration of the leg edge through the other panel.

Figure 2:
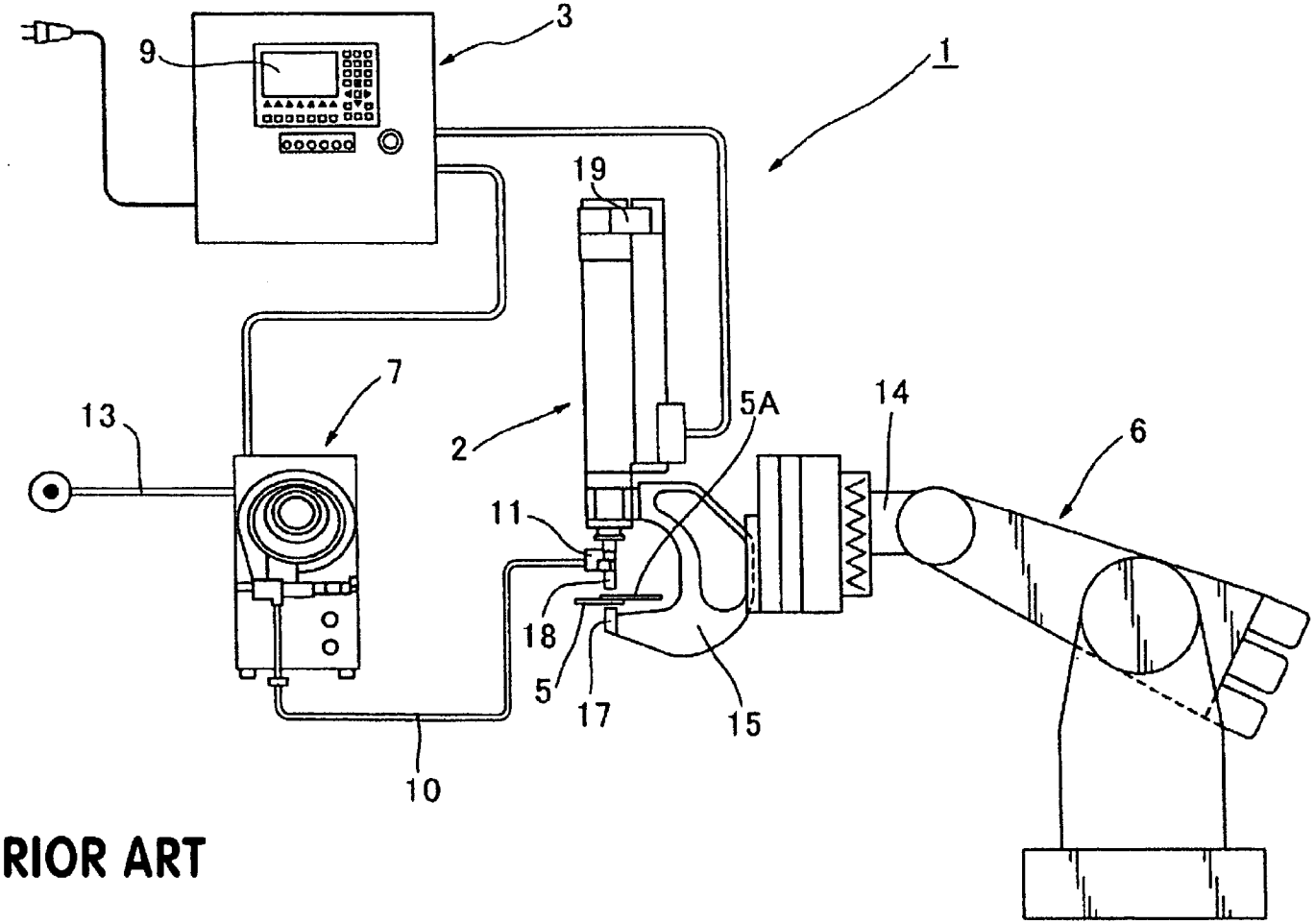
FIG. 2 is a schematic block diagram of a self-piercing rivet setting machine.
Figure 4:
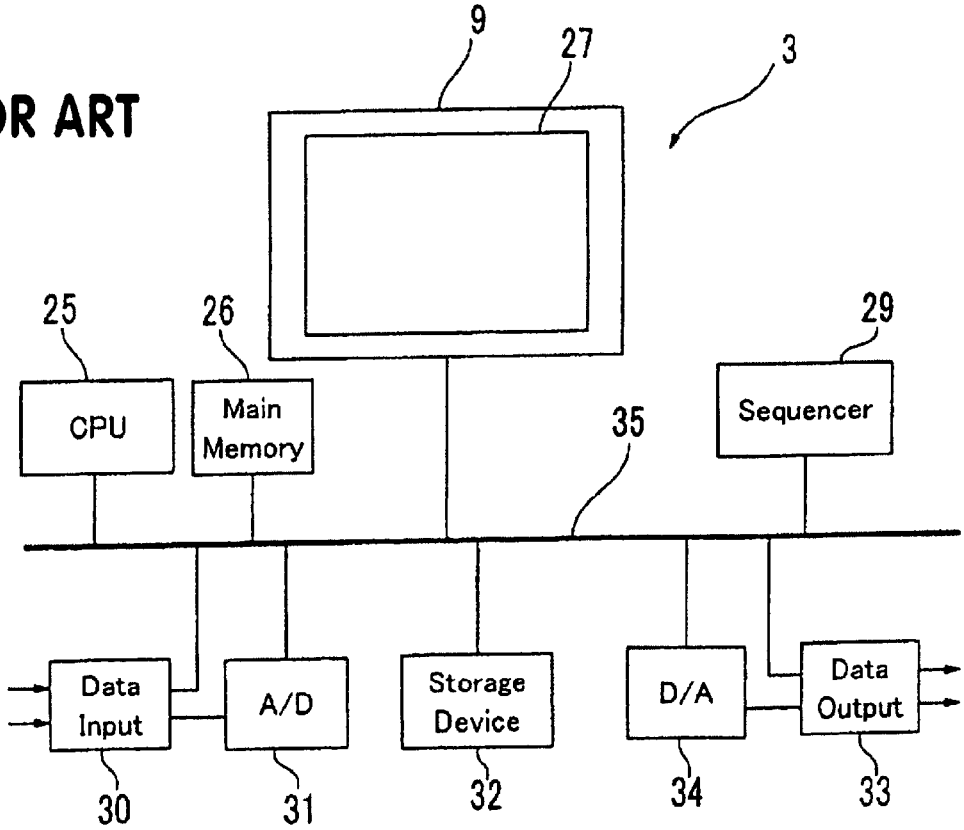
FIG.4 PRIOR ART
FIG. 4 is a block diagram of the hardware of a control unit in a self-piercing rivet setting machine.

The monitor 9 of FIG. 2 is adapted to display and plot the graph having the X-Y coordinates representing the rivet driven stroke and rivet driving load of a self-piercing rivet and to monitor a first setting defect caused by either insufficient or excessive driving force. For the monitoring and the setting control of a self-piercing rivet, the control unit 3 has a hardware configuration as shown in FIG. 4. Specifically, the control unit 3 comprises a central processing unit (CPU) 25, a main memory 26 for carrying out operations and processings in conjunction with the CPU 25, the monitor 9 having a display screen 27, a sequencer 29 for instructing and selecting an automatic setting operation of the self-piercing rivet, a data input unit 30 for entering data of the rivet driving load from a pressure sensor (not shown) at the end of the punch 18, and data of the rivet driven stroke from a scale (not shown) representing a moving distance of the punch 18 at the motor 19 of the setting section 2 or the lead screw, i.e. the rivet driven stroke of a self-piercing rivet, an A/D converter 31 for converting the rivet driving load data or the rivet driven stroke data to digital data if they are analog data, a storage unit 32 such as a hard disk device for storing various data, a data output section 33 for providing various data processed in the control unit 3 to outside, and a D/A converter 34 for converting various internally processed digital data to analog data and transmitting them to the data output section 33. They are communicated with each other through a main bus 35 of the control unit 3 to carry out predetermined processings and functions.

As above, in the monitor 9 of the control unit 3, a normal upper limit curve defining the upper limit of a normal setting range and a normal lower limit curve defining the lower limit of the normal setting range are plotted on the graph having X-Y coordinates representing the rivet driven stroke and (or versus) the rivet driving load in order to detect setting defects of the self-piercing rivet. On the graph of FIG. 1 as described above, the normal upper limit curve A and the normal lower limit curve B are plotted. When input data of the rivet driven stroke-to-the rivet driving load of a self-piercing rivet during a rivet driving operation are plotted between the normal upper limit curve A and the normal lower limit curve B, the rivet driving operation will be determined as normal. However, if the plotted value goes across either the normal upper limit curve A or the normal lower limit curve B and deviates from the values between both the curves, it will be detected that the first setting defect of the self-piercing rivet is caused by either insufficient or excessive driving force. The detected setting defect is indicated to an operator as an alert, and the setting device stops its operation. The normal upper limit curve A and the normal lower limit curve B are acquired on an experimental basis through self-piercing rivet driving tests. For acquiring the characteristic curves, their values can be determined on an experimental basis, and any suitable values representing a normal setting state may be used.

As described with reference to FIG. 1, not all of actual setting defects cannot be detected only by the aforementioned method. For example, in the rivet driving operation providing the characteristic curve C which increases approximately linearly between the normal upper limit curve A and the normal lower limit curve B, the self-piercing rivet is actually overturned in the punch of the setting machine, and the rivet driving operation could not be normally carried out. This setting defect is different from the first setting defect which is caused by either excessive or insufficient driving force, and it cannot be detected by the conventional detecting method. As an example of another setting defects different from the first setting defect, there is a setting defect caused by insufficient hardness of a self-piercing rivet material.

Figure 5:
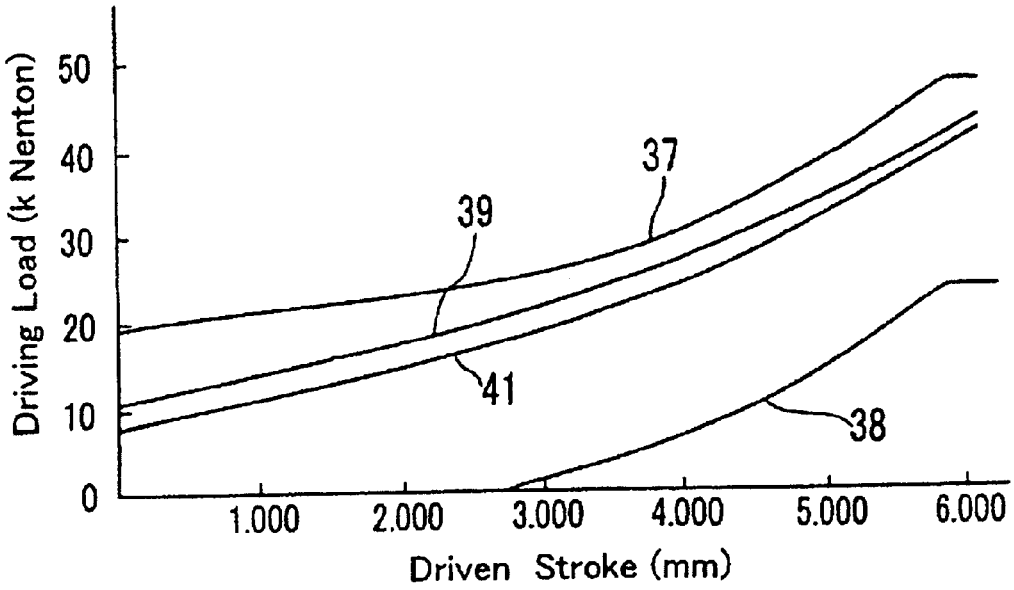
FIG. 5 is a graph of the rivet driven stroke-to-the rivet driving load of a self-piercing rivet, in which normal upper and lower limit curves are plotted for detecting the first setting defect, and defect upper and lower limit curves are plotted for representing the second setting defect, according to the present invention.

Without any addition or modification in the hardware configuration, the present invention achieves to detect the above setting defects or second setting defects which could not be detected by the conventional detecting method and are different from the first setting defect caused by either insufficient or excessive driving force. The following description will be made with reference to FIGS. 5 to 8 showing the graph having X-Y coordinates representing the rivet driven stroke and (versus) the rivet driving load of a self-piercing rivet. In FIG. 5, curves 37 and 38 are a normal upper limit curve 37 and a normal lower limit curve 38, respectively, which have been already described. The values of these curves can be determined on an experimental basis through self-piercing rivet driving tests, and any suitable values representing a normal setting state may be used. In the present invention, between the normal upper limit curve 37 and the normal lower limit curve 38, a defect upper limit curve 39 and a defect lower limit curve 41 are plotted, and they are obtained from the second setting defects (a setting defect caused by overturning of a self-piercing rivet in the punch, a setting defect caused by insufficient hardness of a self-piercing rivet, and so on), which are different from the first setting defect caused by either excessive or insufficient driving force. These curves 39 and 41 can be obtained from, for example, either data from a self-piercing rivet driving operation carried out with a self-piercing rivet overturned in the punch, as shown by the curve C in FIG. 1, or data from the self-piercing rivet driving operation carried out with a self-piercing rivet made of material having insufficient hardness. Alternately, the data may be obtained from a test causing the second setting defect, or may be prepared by using past data stored in the storage device 32 in the setting machine 1 or in a storage device within a remote computer. Preferably, each value and width of the defect upper and lower limit curves 39, 41 are selected by confirming the actual state of the second setting defect. These defect upper and lower limit curves 39, 41 are arranged to allow the curve C in FIG. 1 to be plotted therebetween. If the rivet driving load data for each of the rivet driven strokes of a driving self-piercing rivet is plotted between the defect upper limit curve 39 and the defect lower limit curve 41 as seen in the curve C, it will be determined as the second setting defect.

Figure 6:
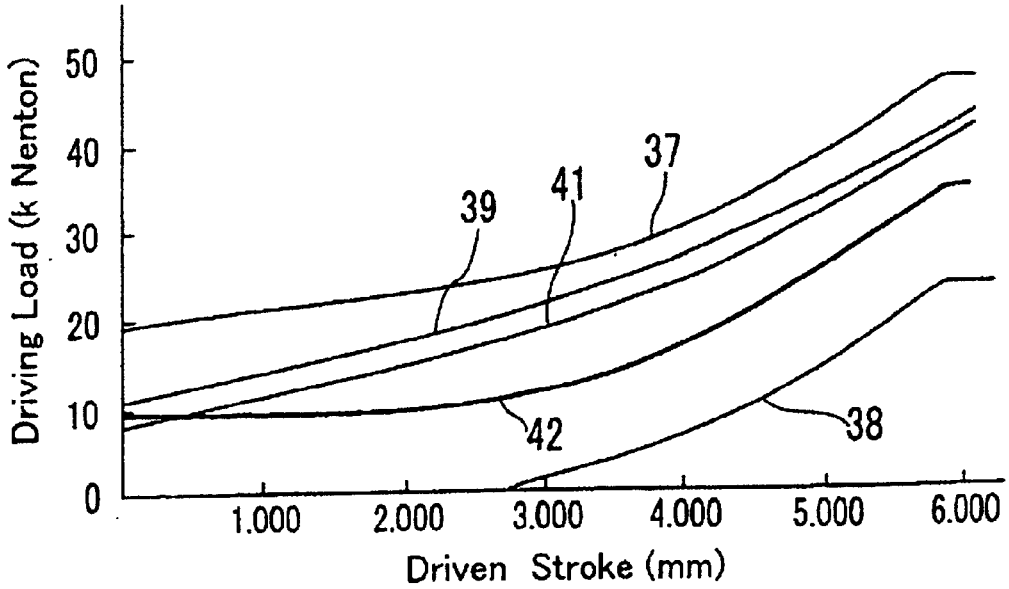
FIG. 6 is a graph formed by plotting actual-measurement data of the rivet driven stroke-to-the rivet driving load of a self-piercing rivet in a normal setting state, as superimposed on the graph of FIG. 5.
Figure 7:
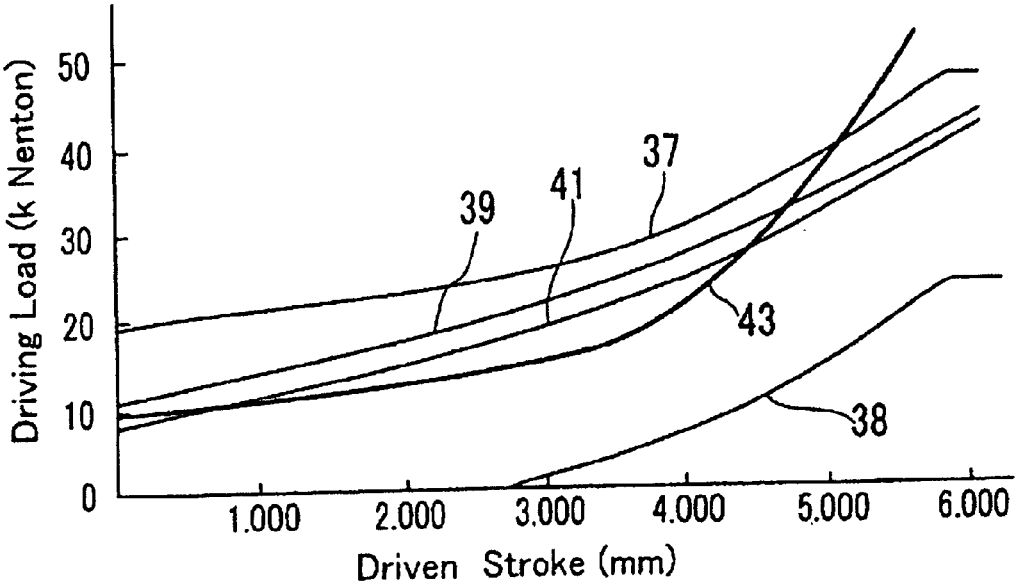
FIG. 7 is a graph formed by plotting actual-measurement data of the rivet driven stroke-to-the rivet driving load of a self-piercing rivet driven with excessive driving force, as superimposed on the graph of FIG. 5.

FIG. 6 shows a plotted value curve 42 for a normally set self-piercing rivet on the graph of FIG. 5 in a superimposed fashion with the curve 42 being formed by plotting values of the rivet driving load for each of the rivet driven strokes of the self-piercing rivet in a normal setting state. The plotted value curve 42 lies between the normal upper limit curve 37 and the normal lower limit curve 38 up to a rivet driven stroke of 6 mm where the entire rivet driving operation is completed, and does not enter in the range between the defect upper limit curve 39 and the defect lower limit curve 41. Thus, no setting defect is detected. FIG. 7 shows a plotted value curve 43 different from that in FIG. 6, which is formed by plotting values of the rivet driving load for each of the rivet driven strokes of the self-piercing rivet in a superimposed fashion on the graph of FIG. 5. At the point of the rivet driven stroke of 5 mm prior to the completion of the rivet driving operation, the plotted value curve 43 goes across the normal upper limit curve 37 and deviates from the values between the normal upper limit curve 37 and the normal lower limit curve 38. In this case, the self-piercing rivet setting machine 1 detects the first setting defect and generates a setting defect signal which is used to indicate a setting defect on the monitor 9 or the like as an alert for an operator, and the rivet setting machine 1 stops its operation.

Figure 8:
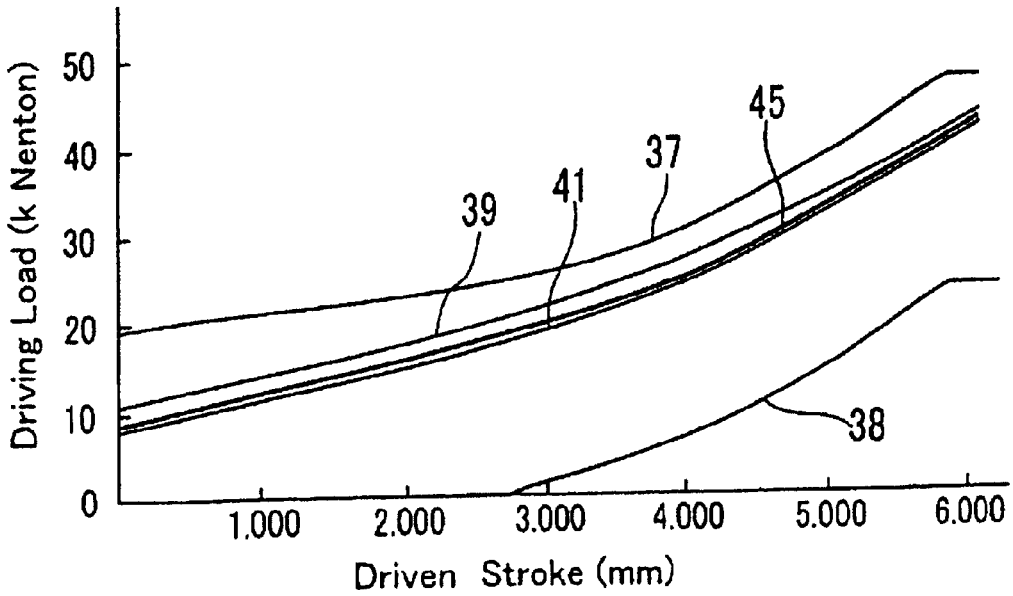
FIG. 8 is a graph formed by plotting actual-measurement data of the rivet driven stroke-to-the rivet driving load of a self-piercing rivet having the second setting defect different from the first setting defect in FIG. 7, as superimposed on the graph in FIG. 5.

FIG. 8 shows the state that a plotted value curve 45 different from those in FIGS. 6 and 7, which is formed by plotting values of the rivet driving load for each of the rivet driven strokes of the self-piercing rivet in the superimposed fashion on the graph of FIG. 5. The plotted value curve 45 lies between the normal upper limit curve 37 and the normal lower limit curve 38 up to the rivet driven stroke of 6 mm where the entire rivet driving operation is completed. However, the plotted value cure 45 lies between the defect upper limit curve 39 and the defect lower limit curve 38 up to the rivet driven stroke of 6 mm. In this case, it will be determined that the set self-piercing rivet has the second setting defect (the setting defect caused by overturning of the self-piercing rivet in the punch or the setting defect caused be insufficient hardness of a material for the self-piercing rivet) different from the first setting defect which is caused by excessive or insufficient driving force. When detecting the second setting defect, the self-piercing rivet setting machine 1 also generates a setting defects signal. Then, the detected setting defect is indicated on the monitor 9 or the like as an alert for the operator, and the rivet setting machine 1 stops its operation. For the second setting defect, a signal representing that this setting defect is not the first setting defect is generated, and the signal may be visibly indicated to the operator. In this manner, the present invention makes it possible to detect the second (or conventionally undetectable) setting defect only by incorporating the defect upper and lower limit curves which are prepared and defined from the second setting defect condition, into the conventional management system based on the normal upper limit curve and the normal lower limit curve, without any modification of the hardware of the self-piercing rivet setting machine 1.

In the aforementioned embodiment, the second setting defect different from the first setting defect caused by excessive or insufficient driving force is detected by adding the defect upper and lower limit curves which can be prepared and defined from the second setting defect state into the graph. Another second setting-defect detecting method different from the aforementioned embodiment will be described below.

Figure 9:
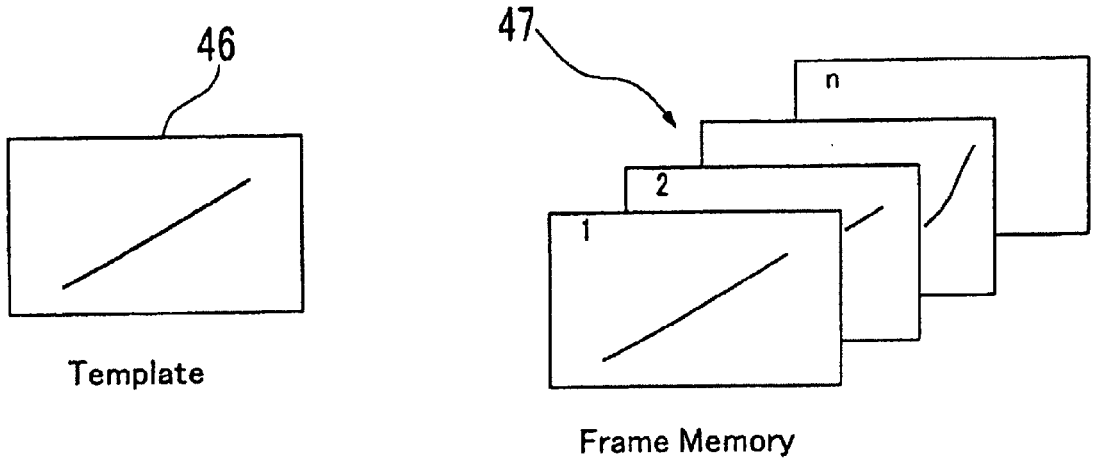
FIG. 9 is an explanatory diagram of another method for detecting the second defect according to another embodiment of the present invention, which shows a template pattern and an actual-measurement pattern of a frame memory.
Figure 10:
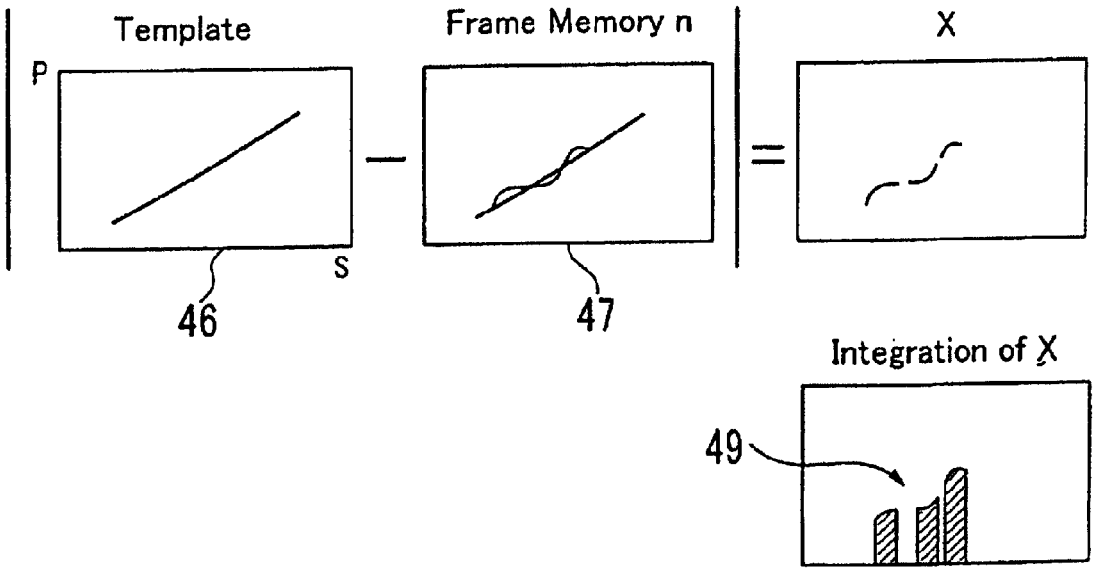
FIG. 10 is an explanatory diagram of the process of performing integration by using the difference between the template and the frame memory in FIG. 9.
Figure 11:
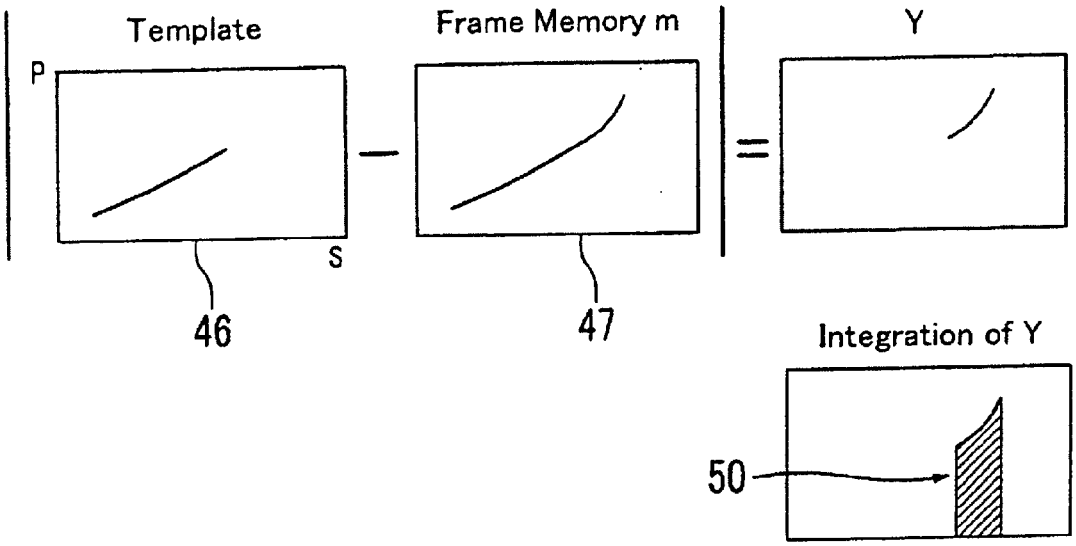
FIG. 11 is an explanatory diagram of the process of performing integration by using the difference between the template of FIG. 9 and the frame memory different from FIG. 10.

Another embodiment of the second setting-defect detecting method is shown in FIGS. 9 to 11. In FIG. 9, a single defect curve pattern (for example, the curve C in FIG. 1) is obtained from the second setting defect different from the first setting defect caused by excessive or insufficient driving force and the curve pattern is stored as a reference template 46. Basically, the template 46 is formed as a pattern on the graph having X-Y coordinates representing the rivet driven stroke and the rivet driving load. The rivet driven stroke is equal to a moving distance of the punch 18 of the rivet setting section 2, and the speed of the punch is substantially constant. Thus, the rivet driven stroke may be represented by a function of time. Then, actual-measurement data of the rivet driving load for each of the rivet driven stroke (time) of a driving self-piercing rivet is stored over the entire rivet driving operation in a frame memory 47 which is an area in the main memory 26 or the storage device 32, as the actual-measurement data in a single frame. As shown in FIG. 10, the difference between data of the reference template 46 and one of the actual-measurement data in the frame memory 47 is calculated. In FIG. 10, if a certain difference is derived from the subtraction of the data in the template 46 from the data in the n-th frame memory 47, a pattern X is obtained by retaining the actual-measurement data of the n-th frame memory only at the time when the difference is present. This pattern X is integrated to provide an integral pattern 49. Based on the magnitude of this integrated value, the presence of the second defect can be detected. In FIG. 11, if a certain difference is derived from subtracting the data of the template 46 from the data of the m-th frame memory 47, a pattern Y is formed by retaining the actual-measurement data of the m-th frame memory only at the time when the difference is present. This pattern Y is integrated to provide an integral pattern 50. Based on the magnitude of this integrated value, the presence of the second defect can be detected. Alternatively, the differences between the data of the template data and the data of the frame memory data may be integrated to detect the second setting defect on the basis of the magnitude of the integrated value of the differences. The integration as shown in FIGS. 10 and 11 is advantageous to detect the second defect with enhanced accuracy because many setting defects are caused near to the end of the rivet driven stroke. The criterion or range of the magnitude of the integrated value is prepared in advance by either test data or past actual data. The template may be obtained by extracting various setting defect conditions from the test data or past actual data, and storing the data for each type of setting defects in the form of a table as a database (the data may be stored in the storage device 32 of the control unit 1 or the storage device of the remote computer). Upon detecting the setting defect, the type of the setting defect may be simultaneously outputted. Further, an alert may be generated and the machine is stopped.

In another alternative method, setting defect curves (for example, the curve C in FIG. 1) are modeled so that in the data of the setting defect curve, each change of the rivet driving load is captured per each driven stroke unit or each predetermined time interval and the captured load changes are stored in a table as a template. The data is stored in the template in the form of the tendency in the change for each type of the setting defect curve models. Then, in an actual-measurement data of a self-piercing rivet during a rivet driving operation, the tendency in the change of a rivet driving load is picked up. For this purpose, plotting is made on the basis of the difference between a rivet driving load value at each of either the rivet driven stroke unit or the predetermined time interval and another rivet driving load value at either the adjacent rivet driven stroke unit or the adjacent time interval. This difference is compared with the data of the change in the template. The template having the same tendency of the change is extracted, and the type of setting defect is specified. More specifically, a single defect curve pattern obtained from the second setting defect different from the first setting defect is stored in the storage device 32 or the like, as a reference pattern including data varying for each of predetermined rivet driven strokes. Then, actual-measurement data of the rivet driving load for the rivet driven stroke is recorded from a driving self-piercing rivet as data varying for each of the predetermined rivet driven strokes. The recorded data are compared with the reference pattern data to determine if the recorded data are approximate to the reference pattern data, and the approximate or same data is detected as the second setting defect. After detecting the setting defect, the type of the setting defect is simultaneously determined and outputted. Further, an alert is generated and the machine is stopped. The range of the degrees that said recorded data approximates to said reference template data is preferably defined in advance by test data or past actual data for detecting the second setting defect. In this embodiment, the setting defect can be determined in the course of the rivet driving operation. In particular, the setting defect can be detected, for example, by finding a significant point on a curve based on the actual-measurement data and detecting that an actual-measurement value passes through the point.

The present invention makes it possible to detect the second (or conventionally undetectable) setting defect only by incorporating either the defect upper and lower limit curves which are prepared and defined from the second setting defect state other than the first setting defect caused by insufficient or excessive driving force, or the template or the like including the reference curve obtained from the second setting defect, into the conventional method and system according to the normal upper limit curve and the normal lower limit curve.

We claim:

1. In a self-piercing rivet setting machine wherein a self-piercing rivet comprising a flange-shaped head and an annular leg extending downward from said head is driven into a plurality of workpieces by a punch and a die to outwardly expand and deform the edge of said leg while piercing said workpieces with said leg, so as to connect said workpieces with each other between said deformed leg and said head, a method for detecting a setting defect of the self-piercing rivet comprising the steps of:

plotting a normal upper limit curve defining the upper limit of a normal setting range and a normal lower limit curve defining the lower limit of the normal setting range on a graph having X-Y coordinates representing a rivet driven stroke and a rivet driving load;

during driving of the rivet, measuring the rivet driven strokes and rivet driving loads of the self-piercing rivet to plot them on said graph; and determining whether said plotted values would deviate from the values between said normal upper limit curve and said normal lower limit curve to detect a first setting defect of said self-piercing rivet, and wherein said method further comprises the steps of:

plotting a defect upper limit curve and a defect lower limit curve between said normal upper and lower limit curves on said graph, said defect upper and lower limit curves being obtained from a second setting defect different from said first setting defect; and determining whether said plotted value of said driven self-piercing rivet lies between said defect upper limit curve and said defect lower limit curve to detect said second setting defect of said self-piercing rivet.

2. A method as defined in claim 1, wherein said second setting defect is caused by overturning of the self-piercing rivet in said punch.

3. A method as defined in claim 1, wherein said second setting defect is caused by insufficient hardness of the self-piercing rivet.

4. In a self-piercing rivet setting machine wherein a self-piercing rivet comprising a flange-shaped head and an annular leg extending downward from said head is driven into a plurality of workpieces by a punch and a die to outwardly expand and deform the edge of said leg while piercing said workpieces with said leg, so as to connect said workpieces with each other between said deformed leg and said head, a method for detecting a setting defect of the self-piercing rivet comprising the steps of:

plotting a normal upper limit curve defining the upper limit of a normal setting range and a normal lower limit curve defining the lower limit of the normal setting range on a graph having X-Y coordinates representing a rivet driven stroke and a rivet driving load;

during driving of the rivet, measuring the rivet driven strokes and rivet driving loads of the self-piercing rivet to plot them on said graph; and determining whether said plotted values would deviate from the values between said normal upper limit curve and said normal lower limit curve to detect a first setting defect of said self-piercing rivet, and wherein said method further comprises the steps of:

storing a single defect curve pattern as a reference template, said defect curve pattern being obtained from a second setting defect different from said first setting defect;

storing plural actual-measurement data over the entire single rivet driving operation as the actual-measurement data for a single frame, said actual-measurement data being obtained from said plotted value during driving of said self-piercing rivet;

calculating respective differences between said reference template data and said single frame actual-measurement data; and integrating values based on said differences to determine said second setting defect on the basis of the magnitude of said integrated value.

5. A method as defined in claim 4, wherein said second setting defect is caused by overturning of the self-piercing rivet in said punch.

6. A method as defined in claim 4, wherein said second setting defect is caused by insufficient hardness of the self-piercing rivet.

7. In a self-piercing rivet setting machine wherein a self-piercing rivet comprising a flange-shaped head and an annular leg extending downward from said head is driven into a plurality of workpieces by a punch and a die to outwardly expand and deform the edge of said leg while piercing said workpieces with said leg, so as to connect said workpieces with each other between said deformed leg and said head, a method for detecting a setting defect of the self-piercing rivet comprising the steps of:

plotting a normal upper limit curve defining the upper limit of a normal setting range and a normal lower limit curve defining the lower limit of the normal setting range on a graph having X-Y coordinates representing a rivet driven stroke and a rivet driving load;

during driving of the rivet, measuring the rivet driven strokes and rivet driving loads of the self-piercing rivet to plot them on said graph; and determining whether said plotted values would deviate from the values between said normal upper limit curve and said normal lower limit curve to detect a first setting defect of said self-piercing rivet, and wherein said method further comprises the steps of:

storing a single defect curve pattern as a reference template, said defect curve pattern being obtained from a second setting defect different from said first setting defect, and said reference template being composed of data varying in each of predetermined rivet driven strokes;

recording actual-measurement data of the rivet driving load for the rivet driven stroke, as data varying in each of said predetermined rivet driven strokes, said actual-measurement data being obtained from said self-piercing rivet during driving of said rivet; and comparing said recorded data with said reference template data to detect said second setting defect on the basis of the degree that said recorded data approximates to said reference template data.

8. A method as defined in claim 7, wherein said second setting defect is caused by overturning of the self-piercing rivet in said punch.

9. A method as defined in claim 7, wherein said second setting defect is caused by insufficient hardness of the self-piercing rivet.

10. An apparatus for detecting a setting defect of a self-piercing rivet comprising a flange-shaped head and an annular leg extending downward from said head for use in a self-piercing rivet setting machine wherein the self-piercing rivet is driven into a plurality of workpieces by a punch and a die to outwardly expand and deform the edge of said leg while piercing said workpieces with said leg, so as to connect said workpieces with each other between said deformed leg and said head, said setting defect detecting apparatus being operable to display a normal upper limit curve defining the upper limit of a normal setting range and a normal lower limit curve defining the lower limit of the normal setting range on a graph having X-Y coordinates representing a rivet driven stroke and a rivet driving load; to measure the rivet driven strokes and rivet driving loads of the driving self-piercing rivet to plot them on said graph; and to determine whether said plotted values would deviate from the values between said normal upper limit curve and said normal lower limit curve to detect a first setting defect of said self-piercing rivet, and wherein said setting defect detecting apparatus is further operable:

to display a defect upper limit curve and a defect lower limit curve which are obtained from a second setting defect different from said first setting defect, between said normal upper and lower limit curves on said graph; and to determine whether said plotted value of said driven self-piercing rivet lies between said defect upper limit curve and said defect lower limit curve to detect said second setting defect of said self-piercing rivet.

11. An apparatus as defined in claim 10, wherein said second setting defect is caused by overturning of the self-piercing rivet in said punch.

12. An apparatus as defined in claim 10, wherein said second setting defect is caused by insufficient hardness of the self-piercing rivet.

13. An apparatus for detecting a setting defect of a self-piercing rivet comprising a flange-shaped head and an annular leg extending downward from said head for use in a self-piercing rivet setting machine wherein the self-piercing rivet is driven into a plurality of workpieces by a punch and a die to outwardly expand and deform the edge of said leg while piercing said workpieces with said leg, so as to connect said workpieces with each other between said deformed leg and said head, said setting defect detecting apparatus being operable to display a normal upper limit curve defining the upper limit of a normal setting range and a normal lower limit curve defining the lower limit of the normal setting range on a graph having X-Y coordinates representing a rivet driven stroke and a rivet driving load; to measure the rivet driven strokes and rivet driving loads of the driving self-piercing rivet to plot them on said graph; and to determine whether said plotted values would deviate from the values between said normal upper limit curve and said normal lower limit curve to detect a first setting defect of said self-piercing rivet, and wherein said setting defect detecting apparatus is further operable:

to store a single defect curve pattern obtained from a second setting defect different from said first setting defect, as a reference template;

to store plural actual-measurement data obtained over the entire single rivet driving operation from said plotted value, as the actual-measurement data for a single frame: and to calculate respective differences between said reference template data and said single frame actual-measurement data and then integrate values resulted from said differences to determine said second setting defect on the basis of the magnitude of said integrated value.

14. An apparatus as defined in claim 13, wherein said second setting defect is caused by overturning of the self-piercing rivet in said punch.

15. An apparatus as defined in claim 13, wherein said second setting defect is caused by insufficient hardness of the self-piercing rivet.

16. An apparatus for detecting a setting defect of a self-piercing rivet comprising a flange-shaped head and an annular leg extending downward from said head for use in a self-piercing rivet setting machine wherein the self-piercing rivet is driven into a plurality of workpieces by a punch and a die to outwardly expand and deform the edge of said leg while piercing said workpieces with said leg, so as to connect said workpieces with each other between said deformed leg and said head, said setting defect detecting apparatus being operable to display a normal upper limit curve defining the upper limit of a normal setting range and a normal lower limit curve defining the lower limit of the normal setting range on a graph having X-Y coordinates representing a rivet driven stroke and a rivet driving load; to measure the rivet driven strokes and rivet driving loads of the driving self-piercing rivet to plot them on said graph; and to determine whether said plotted values would deviate from the values between said normal upper limit curve and said normal lower limit curve to detect a first setting defect of said self-piercing rivet, and wherein said setting defect detecting apparatus is further operable:

to store a single defect curve pattern as a reference template, said defect curve pattern being obtained from a second setting defect different from said first setting defect, and said reference template being composed of data varying in each of predetermined rivet driven strokes;

to record actual-measurement data of the rivet driving load for the rivet driven stroke, as data varying in each of said predetermined rivet driven strokes, said actual-measurement data being obtained from said driving self-piercing rivet; and to compare said recorded data with said reference template data to detect said second setting defect on the basis of the degree that said recorded data approximates to said reference template data.

17. An apparatus as defined in claim 16, wherein said second setting defect is caused by overturning of the self-piercing rivet in said punch.

18. An apparatus as defined in claim 16, wherein said second setting defect is caused by insufficient hardness of the self-piercing rivet.

* * * * *